US005279720A

United States Patent [19]

Divigalpitiya

[11] Patent Number: 5,279,720

[45] Date of Patent: Jan. 18, 1994

[54] ELECTROPHORETIC DEPOSITION OF TRANSITION METAL DICHALCOGENIDES

[75] Inventor: Weerawanni M. R. Divigalpitiya, Burnaby, Canada

[73] Assignee: Minnesota Mining and Manufacturing Company, St. Paul, Minn.

[21] Appl. No.: 48,923

[22] Filed: Apr. 16, 1993

Related U.S. Application Data

[63] Continuation of Ser. No. 800,675, Nov. 27, 1991, abandoned.

[51] Int. Cl.[5] ..... C25D 13/02

[52] U.S. Cl. ..... 204/181.5; 204/181.6; 204/181.4

[58] Field of Search ..... 204/181.5, 181.6, 181.7, 204/181.4

[56] References Cited

U.S. PATENT DOCUMENTS

| | | | |
|---|---|---|---|
| 2,826,542 | 3/1958 | Shyne et al. | 204/181.5 |
| 4,225,408 | 9/1980 | Barlow et al. | 204/181.5 |
| 4,647,386 | 3/1987 | Jamison | 423/561.1 |
| 4,822,590 | 4/1989 | Morrison et al. | 423/561.1 |
| 4,892,798 | 1/1990 | Lamanna et al. | 430/38 |
| 4,996,108 | 2/1991 | Divigalpitiya et al. | 423/561.1 |
| 5,037,516 | 8/1991 | Buck | 204/192.15 |

FOREIGN PATENT DOCUMENTS

0426327A2 5/1991 European Pat. Off. .

OTHER PUBLICATIONS

Japanese Abstract No. 53029233 (Fujikura Cable Works KK).

Japanese Abstract No. 70018184 (Suwa Seikosha Co. Ltd.).

"Chemical Synthesis of Conducting Polypyrrole and Some Composites," Bocchi et al., *J. Chem. Soc., Chem Commun.*, 1986, p. 148.

"Physico-Chemical Characterization of Molybdenum Dichalcogenide Thin Films," Bernede et al., *Mat. Chem and Phys.*, 28 (1991), pp. 347-354.

*Primary Examiner*—John Niebling

*Assistant Examiner*—Kishor Mayekar

*Attorney, Agent, or Firm*—Gary L. Griswold; Walter N. Kirn; Gregory D. Allen

[57] ABSTRACT

This invention relates to a method of depositing thin coatings of transition metal dichalcogenides on substrates having an electrically-conductive surface. The transition metal dichalcogenide coating is useful, for example, as a release layer in the casting of polymeric materials.

19 Claims, No Drawings

ELECTROPHORETIC DEPOSITION OF TRANSITION METAL DICHALCOGENIDES

This is a continuation of application Ser. No. 07/800,675, now abandoned, filed Nov. 27, 1991.

FIELD OF THE INVENTION

This invention relates to a method of depositing thin coatings of transition metal dichalcogenides on substrates having an electrically-conductive surface.

DESCRIPTION OF THE RELATED ART

Layered transition metal dichalcogenides have a variety of useful properties due to their anisotropic structure. For example, molybdenum disulfide is widely used as a dry, solid lubricant, a catalyst, and an electrode material in intercalation batteries.

Deposition methods are known in the art for depositing thin coatings of molybdenum disulfide onto substrates. Such deposition techniques generally involve the use of a vacuum and, hence, tend to be expensive. For example, U.S. Pat. No. 5,037,516 (Buck) teaches a process for applying a $MoS_2$ coating onto a substrate in which, within a sputter chamber, molybdenum disulfide is released in a gas discharge from a molybdenum disulfide target and deposited onto the substrate, in order to produce a lamella structure extending parallel to the surface of the substrate.

An alternative technique for depositing transition metal dichalcogenides (e.g., molybdenum disulfides) is disclosed in U.S. Pat. No. 4,996,108 (Divigalpitiya et al.), wherein a sheet-like composition formed at an interface between water and a non-metallic liquid which is immiscible with water is brought in contact with an object such that the sheet-like composition is allowed to spread over the object. The sheet-like composition having the formula $MX_2$:Y, wherein $MX_2$ is a layer-type transition metal dichalcogenide, wherein M is selected from the group consisting of niobium, tantalum, molybdenum, and tungsten; X is selected from the group consisting of sulfur and selenium; and Y is a material located between layers of $MX_2$.

U.S. Pat. No. 4,822,590 (Morrison et al.), discloses single layer materials of the form $MX_2$, where $MX_2$ is a layer-type dichalcogenide such as $MoS_2$, $TaS_2$, $WS_2$, or the like, exfoliated by intercalation of an alkali metal, and immersion in water. $MoS_2$ was exfoliated into monolayers by intercalation with lithium followed by reaction with water. By absorbing monolayers or precipitating clusters of various species such as compounds of Co, Ni, Pb, Cd, Al, Ce, In, and Zn, on $MoS_2$ while the sulfide is suspended as single layers and then recrystallizing, a new group of inclusion compounds can be formed.

There is a need for an improved process for a controlled deposition of uniform thin coatings of transition metal dichalcogenide on substrates, including substrates having complex geometries

SUMMARY OF THE INVENTION

Briefly, the present invention provides a method for depositing a coating comprising transition metal dichalcogenide particles onto a substrate, said method comprising the steps of:

(a) providing a suspension comprising exfoliated transition metal dichalcogenide particles suspended in a carrier liquid, the transition metal dichalcogenide being represented by the formula $MX_2$, wherein M is a transition metal selected from the group consisting of niobium, tantalum, molybdenum, and tungsten, and wherein X is a chalcogen selected from the group consisting of sulfur and selenium;

(b) providing a substrate having an electrically conductive surface; and (c) contacting at least a portion of said electrically conductive surface with said suspension and electrophoretically and irreversibly depositing said transition metal dichalcogenide particles onto at least a portion of the electrically conductive surface. The term "exfoliated particles" as used herein refers to single or multiple layered particles. Preferably, the exfoliated transition metal dichalcogenide particles are single molecular layer particles. For example, a single molecular layer of $MoS_2$ consists of a sheet of molybdenum (Mo) atoms sandwiched between two sheets of sulfur (S) atoms.

The term "electrophoretically and irreversibly depositing" as used herein means depositing particles in a suspension onto a substrate by means of an electric field, wherein the particles migrate from the suspension to the surface of the substrate in contact with the suspension, and adhere to the substrate surface.

The method according to the present invention is a convenient process for the controlled deposition of uniform, thin coatings of transition metal dichalcogenide particles onto the surface of both simple and complex geometric substrates.

The transition metal dichalcogenide coating prepared according to the present invention is useful, for example, as a release layer in the casting of polymeric materials.

DESCRIPTION OF THE PREFERRED EMBODIMENTS

Suitable exfoliated transition metal dichalcogenide can be prepared, for example, by exfoliating powders of transition metal dichalcogenides in water by methods known in the art, such as that described in U.S. Pat. No. 4,822,590 (Morrison et al.), the disclosure of which is incorporated herein by reference. Specifically Morrison et al. teach first soaking $MoS_2$ (suitable $MoS_2$ commercially available, for example, under the trade designations "MOLYBDENUM (IV) SULFIDE" from Aldrich Chemical Co., Inc. of Milwaukee, Wis. and "MOLYBDENUM (IV) SULFIDE" from Johnson Matthey, Alfa Products of Ward Hill, Mass.) in a solution of n-butyl lithium (commercially available, for example, under the trade designation "BUTYLLITHIUM" from Aldrich Chemical Co., Inc.) in hexane, usually for about 48 hours, in a controlled atmosphere enclosure (e.g.,a dry box) with an argon atmosphere. Concentration of the n-butyl lithium solution is typically in the range from about 0.2 to about 2.6M. During the soak, intercalation of the $MoS_2$ by lithium is said to occur, providing $Li.MoS_2$ having a mole fraction of at least $X=1$. Following intercalation, the $MoS_2$ is removed after decanting the supernatant, washed repeatedly in hexane, and sealed in a vial, while under an argon atmosphere. The vial is then removed from the controlled atmosphere enclosure, immersed in water, and the cap of the vial removed. Upon contact with water, copious gas evolution occurs, and the $MoS_2$ powder and water form a highly opaque suspension.

Further, Morrison et al. state that although not wanting to be bound by theory, they hypothesize that the reaction of the water and the intercalated lithium forms hydrogen gas between the layers, and expansion of the hydrogen gas tends to separate the $MoS_2$ layers. As the reaction proceeds more deeply into each crystallite, the $MoS_2$ layers become further separated. Eventually the $MoS_2$ layers become completely separated and remain suspended in the aqueous solution.

Tantalum (IV) sulfide, tantalum (IV) selenide, niobium (IV) sulfide, tungsten (IV) sulfide, and tungsten (IV) selenide are commercially available, for example, from Johnson Matthey, Alpha Products Preferred liquid media for exfoliating transition metal dichalcogenide particles are protic (e.g., water). Although low protic liquids (e.g., alcohols) are useful to exfoliate the particles, highly protic liquids (e.g., water) are generally more effective.

Preferred liquid media for exfoliating the transition metal dichalcogenide particles is typically not the preferred carrier liquid for the suspension. The liquid medium used to exfoliate the transition metal dichalcogenide particles is usually replaced with the carrier liquid. To provide a more uniform suspension, it is preferable that liquid medium and carrier liquid be miscible. Use of immiscible liquids allows the liquid medium and carrier liquid to separate over time, providing a non-uniform suspension.

Preferably, exfoliated, layered transition metal dichalcogenide particles have a planar dimension of less than about 1 micrometer. More preferably, the planar dimension of the layered particles is on the order of a few hundred nanometers.

For transition metal dichalcogenide particles prepared by exfoliating powders in water, the layers are re-suspended in a carrier liquid. Although the carrier liquid can be water, the preferred carrier liquid is less polar than water. Use of a carrier liquid having a low concentration of ions is preferred because use of such a carrier liquid provides a superior quality transition metal dichalcogenide coating (i.e, the appearance of coatings deposited from a suspension having a low ion concentration is more uniform than that of a coating deposited from a suspension having a carrier liquid having a high ion concentration).

Preferred carrier liquids include, for example, isopropyl alcohol, ethanol, methanol, n-propyl alcohol, cyclohexane, and combinations thereof. The most preferred carrier liquid is isopropyl alcohol.

Preferably, the transition metal dichalcogenide/carrier liquid suspension comprises in the range from about 0.001 to about 5 percent by weight transition metal dichalcogenide, based on the total weight of the suspension. More preferably, the suspension comprises in the range from about 0.002 to about 0.02 percent by weight transition metal dichalcogenide, based on the total weight of the suspension. Use of suspensions having transition metal dichalcogenide concentrations below the specified values tend to require excessive deposition times. Concentrations higher than the specified values tend to form slurries rather than suspensions.

Transition metal dichalcogenide particles can be single layered or multi-layered. Typically, the fewer the number of layers present in each particle, the more uniform the resulting coating is. Further, the higher the number of layers in each particle, generally the higher electric field needs to be during electrophoretic deposition. The most preferred transition metal dichalcogenide particles are single molecular layer transition metal dichalcogenide particles.

Geometry of the substrate surface to be coated can be in any shape, from a simple geometric shape to a complex geometric shape. If the surface of the substrate is not electrically-conductive, it can be made so by depositing an electrically-conductive material thereon. Preferred electrically-conductive materials include nickel, copper, silver, gold, stainless steel, platinum, palladium, and carbon. Such electrically-conductive materials can be deposited on the surface of the substrate using conventional techniques such as vapor coating or electroless plating.

Other suitable electrically-conductive materials include, for example, electrically conductive polymeric materials such as polypyrroles, polyacetylene, polyparaphenylene, and combinations thereof. Such polymers may be deposited by techniques known in the art including, for example, that disclosed in "Chemical Synthesis of Conducting Polypyrrole and Some Composites," V. Boochi and G. P. Gardini, *J. Chem. Soc., Chem. Comm.*, 1986, p. 148, the disclosure of which is incorporated herein by reference. For example, a polypyrrole coating can be deposited onto a substrate by first coating the substrate (e.g., brushing, spraying, dipping, etc.) with an aqueous $FeCl_3$ solution (e.g., 30 percent by weight $FeCl_3$), and then exposing the $FeCl_3$ coating to pyrrole vapors (e.g., hanging the coated substrate over a pyrrole solution (e.g., 10 percent by weight pyrrole) in toluene or benzene) for a time sufficient to provide a polypyrrole coating on the surface of the substrate. Alternatively, a substrate may be coated with polypyrrole by first coating the substrate with an aqueous $FeCl_3$ solution (e.g., 30 percent by weight $FeCl_3$), and then coating the substrate with a pyrrole solution (e.g., 10 percent by weight pyrrole) in toluene or benzene. Prior to electrophoretically depositing a transition metal dichalcogenide onto the pyrrole coated substrate, the pyrrole coating is typically washed with water (followed by acetone, if desired) and then dried.

During electrophoretic deposition of the transition metal dichalcogenide onto the substrate surface, the substrate may be either the anode or the cathode. Whether the substrate to be coated is an anode or a cathode is dependent on the charge of the exfoliated transition metal dichalcogenide particles in the suspension. For example, if the charge on the particles is negative, the substrate to be coated is an anode. Typically, the charge on the exfoliated transition metal dichalcogenide particles is negative due to the presence of basal hydroxy groups, as describe in U. S. Pat. No. 4,996,108 (Divigalpitiya et al.), the disclosure of which is incorporated herein by reference.

The charge on the exfoliated transition metal dichalcogenide particles may be made positive, for example, by adding a charge directing agent (e.g., an appropriate surfactant) to the suspension. The cathode (if the substrate to be coated is the anode) or the anode (if the substrate to be coated is the cathode) can be any suitable electrically conductive material known in the art for such use.

Thickness of deposited transition metal dichalcogenide is dependent on transition metal dichalcogenide concentration of the suspension, voltage applied across the anode and cathode, and deposition time.

Voltage across the anode and cathode can be supplied by conventional means. Typically, the voltage is in the range from about 0.1 to about 50 volts. Preferably, the voltage is in the range from about 1 to about 30 volts.

Deposition time, which is dependent on the voltage, is typically in the range from about 1 to about 30 minutes.

Preferably, the amount of transition metal dichalcogenide deposited onto the electrically-conductive surface of the substrate is in an amount sufficient to provide a thickness in the range from a monolayer to about 10 micrometers. More preferably, the amount of transition metal dichalcogenide deposited is sufficient to provide a thickness in the range from a monolayer to about 1 micrometer, and, most preferably, in an amount sufficient to provide a thickness in a range from a monolayer to about 0.5 micrometer.

Preferably, the deposited transition metal dichalcogenide coating is heated at a temperature, for a time, and in an atmosphere (typically air) sufficient to provide a transition metal dichalcogenide coating that is essentially free of organic material, essentially free of water, or both.

A transition metal dichalcogenide coating prepared according to the present invention can be continuous (i.e., the coating completely covers the surface of the substrate that is in contact with the suspension during electrophoretic deposition) or discontinuous.

The transition metal dichalcogenide coating deposited according to the present invention typically is well adhered to the electrically conductive surface onto which it is coated, and is uniformly deposited on to the surface which was in contact with the suspension during deposition.

The transition metal dichalcogenide coating is useful, for example, as a release layer in the casting of polymeric materials.

Objects and advantages of this invention are further illustrated by the following examples, but the particular materials and amounts thereof recited in these examples, as well as other conditions and details, should not be construed to unduly limit this invention. All parts and percentages are by weight, unless otherwise indicated.

EXAMPLE 1

Example 1 illustrates the deposition of molybdenum disulfide onto an aluminum substrate using the method of the present invention.

A dispersion of exfoliated, single molecular layer, molybdenum disulfide particles in water was prepared as described in U.S. Pat. No. 4,822,590 (Morrison et al.), the disclosure of which is incorporated herein by reference. Specifically, about 1 gram of $MoS_2$ particles (commercially available under the trade designation "MOLYBDENUM (IV) SULFIDE" from Aldrich Chemical Co., Inc. of Milwaukee, Wis.) was added to about 50 ml of a 2.5 solution of n-butyllithium in hexane (commercially available under the trade designation "BUTYLLITHIUM" from Aldrich Chemical Co., Inc.), while in a dry box having an argon atmosphere. The $MoS_2$ particles were allowed to soak in the solution for about 48 hours. The supernatant was then decanted and the lithiated $MoS_2$ washed in hexane. The washed $MoS_2$ was sealed in a glass reagent bottle with a ground glass cap. The sealed bottle was removed from the dry box having the argon atmosphere. The bottle was opened in air and about 80 ml of water was added, whereupon copious gas evolution was observed when the water and the $MoS_2$ came into contact. The resulting suspension was washed several times with water (about 80 ml per washing) by centrifuging and decanting. The washed suspension was diluted with a sufficient amount of isopropyl alcohol to provide a suspension containing about 0.02% solids. This suspension contained about 0.5% water. About 500 grams of the suspension was transferred to a rectangular shaped, 1.25 liter glass container.

An aluminum (grade 6061) substrate, which was in the shape of a rectangular sheet ( 22 cm×10 cm×0.5 mm), was used as the anode. The cathode was a rectangular stainless steel screen (mesh #28; 22 cm×10 cm×0.5 mm). The cathode and the anode were placed into the suspension, about 0.5 cm apart. Voltage applied across the anode and cathode was about 30 volts direct current. Average deposition rate was estimated to be on the order of about 10 nanometers per minute. Electrophoretic deposition was carried out for about 20 minutes.

The coated substrate was heated in a vacuum oven at about 200° C. for about 3 hours to drive off volatile substituents (e.g.,water and alcohol).

The resulting molybdenum disulfide coating had a uniform metal blue lustre and a uniform appearance. The molybdenum disulfide coating is useful as a release layer in the casting of polymer materials.

EXAMPLE 2

Example 2 illustrates the deposition of molybdenum disulfide onto a stainless steel (grade 304) substrate.

A coated substrate was prepared as described above in Example 1, except the substrate was stainless steel having a rectangular geometry (22 cm×10 cm×1 mm).

The resulting molybdenum disulfide coating had a uniform metal blue lustre and a uniform appearance. The molybdenum disulfide coating is useful as a release layer in the casting of polymer materials.

EXAMPLE 3

Example 3 illustrates the deposition of molybdenum disulfide onto a conductive polymer coating.

A glass microscope slide was dipped in a solution comprising about 30 weight percent ferric chloride (commercially available from Aldrich Chemical Co., Inc.) in methanol. The microscope slide was removed from the ferric chloride solution and then exposed to pyrrole vapor by hanging the slide over a solution containing about 10 percent pyrrole (commercially available from Aldrich Chemical Co., Inc.) in toluene. After a few minutes, a black polymer coating of polypyrrole was present on the glass slide. The resulting black polymer coating was washed several times with deionized water and dried in air. The resulting electrically-conductive polymerically coated substrate (i.e., glass slide) was then used as an anode to electrophoretically deposit molybdenum disulfide according to the manner described in Example 1.

The resulting black, molybdenum disulfide coating had a uniform appearance.

Although Examples 1-3 illustrate the deposition of molybdenum disulfide onto the surface of a substrate, other transition metal dichalcogenide coatings (i.e., $MoSe_2$, $NbS_2$, $NbSe_2$, $TaS_2$, $TaSe_2$, $WSe_2$, $WS_2$, and combinations with and without $MoS_2$) can be obtained by using appropriate transition metal dichalcogenides in place of or in addition to the molybdenum disulfide.

Various modifications and alterations of this invention will become apparent to one skilled in the art without departing from the scope and spirit of this invention, and it should be understood that this invention is not to be unduly limited to the illustrative embodiments set forth therein.

What is claimed is:

1. A method for depositing a coating consisting essentially of transition metal dichalcogenide particles onto a substrate, said method comprising the steps of:

(a) providing a suspension consisting essentially of exfoliated transition metal dichalcogenide particles suspended in a carrier liquid, said transition metal dichalcogenide being represented by the formula $MX_2$, wherein M is a transition metal selected from the group consisting of niobium, tantalum, molybdenum, and tungsten, and wherein X is a chalcogen selected from the group consisting of sulfur and selenium;

(b) providing a substrate having an electrically conductive surface; and (c) contacting at least a portion of said electrically conductive surface with said suspension and electrophoretically and irreversibly depositing said transition metal dichalcogenide particles onto at least a portion of said electrically conductive surface to provide a coating consisting essentially of said transition metal dichalcogenide particles.

2. The method according to claim 1 wherein said transition metal dichalcogenide particles are single molecular layer transition metal dichalcogenide particles.

3. The method according to claim 2 wherein said transition metal dichalcogenide particles have a planar dimension less than about 1 micrometer.

4. The method according to claim 2 further comprising step (d), wherein said electrically conductive surface having said transition metal dichalcogenide particles deposited thereon is heated at a temperature, for a time, and in an atmosphere sufficient to provide a transition metal dichalcogenide coating that is essentially free of organic material.

5. The method according to claim wherein said transition metal dichalcogenide is molybdenum disulfide.

6. The method according to claim wherein said transition metal dichalcogenide particles have a planar dimension less than about 1 micrometer.

7. The method according to claim wherein said transition metal dichalcogenide particles are present in said suspension in the range from about 0.001 to about 5 percent by weight, based on the weight of said suspension.

8. The method according to claim wherein said transition metal dichalcogenide particles are present in said suspension in the range from about 0.002 to about 0.02 percent by weight, based on the weight of said suspension.

9. The method according to claim 1 wherein said carrier liquid is selected from the group consisting of isopropyl alcohol, ethanol, methanol, n-propyl alcohol, cyclohexane, and combinations thereof.

10. The method according to claim 1 wherein said carrier liquid is isopropyl alcohol.

11. The method according to claim 1 wherein said transition metal dichalcogenide particles are deposited on said electrically conductive surface in an amount sufficient to provide a thickness in the range from a monolayer to about 10 micrometers.

12. The method according to claim 1 wherein said transition metal dichalcogenide particles are deposited on said electrically conductive surface in an amount sufficient to provide a thickness in the range from a monolayer to about 1 micrometer.

13. The method according to claim 1 wherein said transition metal dichalcogenide particles are deposited on said electrically conductive surface in an amount sufficient to provide a thickness in the range from a monolayer to about 0.5 micrometer.

14. The method according to claim 1 wherein said electrically conductive surface is a metal.

15. The method according to claim 1 wherein said electrically conductive surface is an electrically conductive material selected from the group consisting of nickel, copper, silver, gold, stainless steel, platinum, palladium, and carbon.

16. The method according to claim 1 wherein said electrically conductive surface is an electrically conductive polymeric material.

17. The method according to claim 1 further comprising step (d), wherein said electrically conductive surface having said transition metal dichalcogenide particles deposited thereon is heated at a temperature, for a time, and in an atmosphere sufficient to provide a transition metal dichalcogenide coating that is essentially free of organic material.

18. The method according to claim 1 further comprising step (d) wherein said electrically conductive surface having said transition metal dichalcogenide particles deposited thereon is heated at a temperature, for a time, and in an atmosphere sufficient to provide a transition metal dichalcogenide coating that is essentially free of water.

19. The method according to claim 1 further comprising step (d) wherein said electrically conductive surface having said transition metal dichalcogenide particles deposited thereon is heated at a temperature, for a time, and in an atmosphere sufficient to provide a transition metal dichalcogenide coating that is essentially free of organic material and essentially free of water.

* * * * *

UNITED STATES PATENT AND TRADEMARK OFFICE

CERTIFICATE OF CORRECTION

PATENT NO. : 5,279,720

DATED : January 18, 1994

INVENTOR(S) : Weerawanni M. E. Divigalpitiya

It is certified that error appears in the above-identified patent and that said Letters Patent is hereby corrected as shown below:

Col. 2, Line 57, "$Li.MoS_2$" should read --$Li_xMoS_2$--.

Col. 7, Line 39, "according to claim" should read --according to claim 1--.

Col. 7, Line 41, "according to claim" should read --according to claim 1--.

Col. 7, Line 49, "according to claim" should read --according to claim 1--.

Col. 7, line 44, "according to claim" should read --according to claim 1--.

Signed and Sealed this

Nineteenth Day of July, 1994

*Attest:*

*Attesting Officer*

BRUCE LEHMAN

*Commissioner of Patents and Trademarks*